US008951116B1

(12) United States Patent
Koenig

(10) Patent No.: US 8,951,116 B1
(45) Date of Patent: Feb. 10, 2015

(54) SLOT MACHINE GAME WITH INTERSECTING WHEELS

(76) Inventor: Nicholas Koenig, Watsonville, CA (US)

( * ) Notice: Subject to any disclaimer, the term of this patent is extended or adjusted under 35 U.S.C. 154(b) by 262 days.

(21) Appl. No.: 12/846,783

(22) Filed: Jul. 29, 2010

Related U.S. Application Data

(60) Provisional application No. 61/273,003, filed on Jul. 29, 2009, provisional application No. 61/229,431, filed on Jul. 29, 2009.

(51) Int. Cl.
*A63F 9/24* (2006.01)

(52) U.S. Cl.
USPC ..... 463/31; 463/16; 463/17; 463/18; 463/19; 463/20

(58) Field of Classification Search
USPC ..... 463/16–20, 31
See application file for complete search history.

(56) References Cited

U.S. PATENT DOCUMENTS

| | | | | |
|---|---|---|---|---|
| 4,200,291 | A | 4/1980 | Hooker | |
| 5,395,111 | A * | 3/1995 | Inoue | 273/143 R |
| 6,413,162 | B1 | 7/2002 | Baerlocher | |
| 6,485,367 | B1 * | 11/2002 | Joshi | 463/13 |
| 6,641,477 | B1 | 11/2003 | Dietz | |
| 6,657,923 | B2 | 12/2003 | Laughlin | |
| 6,893,342 | B1 | 5/2005 | Singer | |
| 6,908,381 | B2 | 6/2005 | Ellis | |
| 6,974,129 | B2 | 12/2005 | Nordman | |
| 7,001,274 | B2 | 2/2006 | Baerlocher | |
| 2003/0017868 | A1 | 1/2003 | Crawford | |
| 2003/0203753 | A1 * | 10/2003 | Muir et al. | 463/20 |
| 2004/0102245 | A1 | 5/2004 | Escalera | |
| 2004/0248640 | A1 * | 12/2004 | Kaminkow et al. | 463/20 |
| 2005/0026678 | A1 | 2/2005 | Kaminkow | |
| 2005/0059455 | A1 | 3/2005 | Gerrard | |
| 2005/0059478 | A1 | 3/2005 | Peterson | |
| 2006/0019738 | A1 | 1/2006 | Baerlocher | |
| 2006/0084498 | A1 | 4/2006 | Baerlocher | |
| 2006/0160595 | A1 * | 7/2006 | Gerson et al. | 463/16 |
| 2006/0183532 | A1 * | 8/2006 | Jackson | 463/20 |
| 2008/0090636 | A1 * | 4/2008 | Lathrop | 463/20 |
| 2008/0113739 | A1 * | 5/2008 | Visser et al. | 463/20 |
| 2008/0139294 | A1 * | 6/2008 | Inamura | 463/20 |
| 2009/0005155 | A1 * | 1/2009 | Rodgers et al. | 463/20 |

FOREIGN PATENT DOCUMENTS

| | | |
|---|---|---|
| GB | 2098780 | 11/1982 |
| JP | 06238033 | 8/1994 |
| JP | 2003000859 | 1/2003 |
| WO | WO9303464 | 2/1993 |

OTHER PUBLICATIONS

Office Action in U.S. Appl. No. 11/581,190 dated Nov. 25, 2008.
Office Action in U.S. Appl. No. 11/581,190 dated Feb. 4, 2010.

* cited by examiner

*Primary Examiner* — Steve Rowland
(74) *Attorney, Agent, or Firm* — Muskin & Farmer LLC

(57) ABSTRACT

A method, apparatus, and computer readable storage to implement a slot machine game. Different wheels can spin simultaneously and paylines can bridge across different wheels to form combinations. Wheels can share intersecting symbols, wherein when one wheel spins it takes the intersecting symbol with that wheel, and when the other wheel that shares the intersecting symbol spins it takes the intersecting symbol with that wheel.

20 Claims, 20 Drawing Sheets

SELECT
SELECT
2nd
SELECT
SELECT
1st
SELECT
SELECT
3rd
SELECT
SELECT
SELECT

PRIOR ART

SLOT MACHINE GAME WITH INTERSECTING WHEELS

CROSS REFERENCE TO RELATED APPLICATIONS

This application claims benefit to both provisional application 61/273,003 Jul. 29, 2009 and also to provisional application 61/229,431, Jul. 29, 2009 both of which are incorporated by reference herein in their entireties.

BACKGROUND OF THE INVENTION

1. Field of the Invention

The present general inventive concept is directed to a method, apparatus, and computer readable storage medium directed to a slot machine game that has intersecting wheels.

2. Description of the Related Art

Slot machines, such as the type illustrated in FIG. 20, typically have fixed reels (either virtual or physical). In other words, the composition of the reels are predetermined and constant each spin.

What is needed is a slot machine game which has variable reels, which provides a player with more variety then the tradition slot games.

SUMMARY OF THE INVENTION

It is an aspect of the present invention to provide an exciting casino wagering game.

The above aspects can be obtained by (a) receiving an wager from a player on an electronic gaming machine to wager on symbols on a payline; (b) displaying a first wheel comprising symbols and a second wheel comprising symbols, wherein the first wheel and the second wheel have at least one intersecting symbol therebetween; (c) spinning the first wheel; (d) spinning the second wheel; and (e) evaluating symbols on the payline to determine whether the symbols on the payline form a winning combination, and if so, paying the player an award associated with the winning combination.

These together with other aspects and advantages which will be subsequently apparent, reside in the details of construction and operation as more fully hereinafter described and claimed, reference being had to the accompanying drawings forming a part hereof, wherein like numerals refer to like parts throughout.

BRIEF DESCRIPTION OF THE DRAWINGS

Further features and advantages of the present invention, as well as the structure and operation of various embodiments of the present invention, will become apparent and more readily appreciated from the following description of the preferred embodiments, taken in conjunction with the accompanying drawings of which.

DESCRIPTION OF THE PREFERRED EMBODIMENTS

Figure 1:
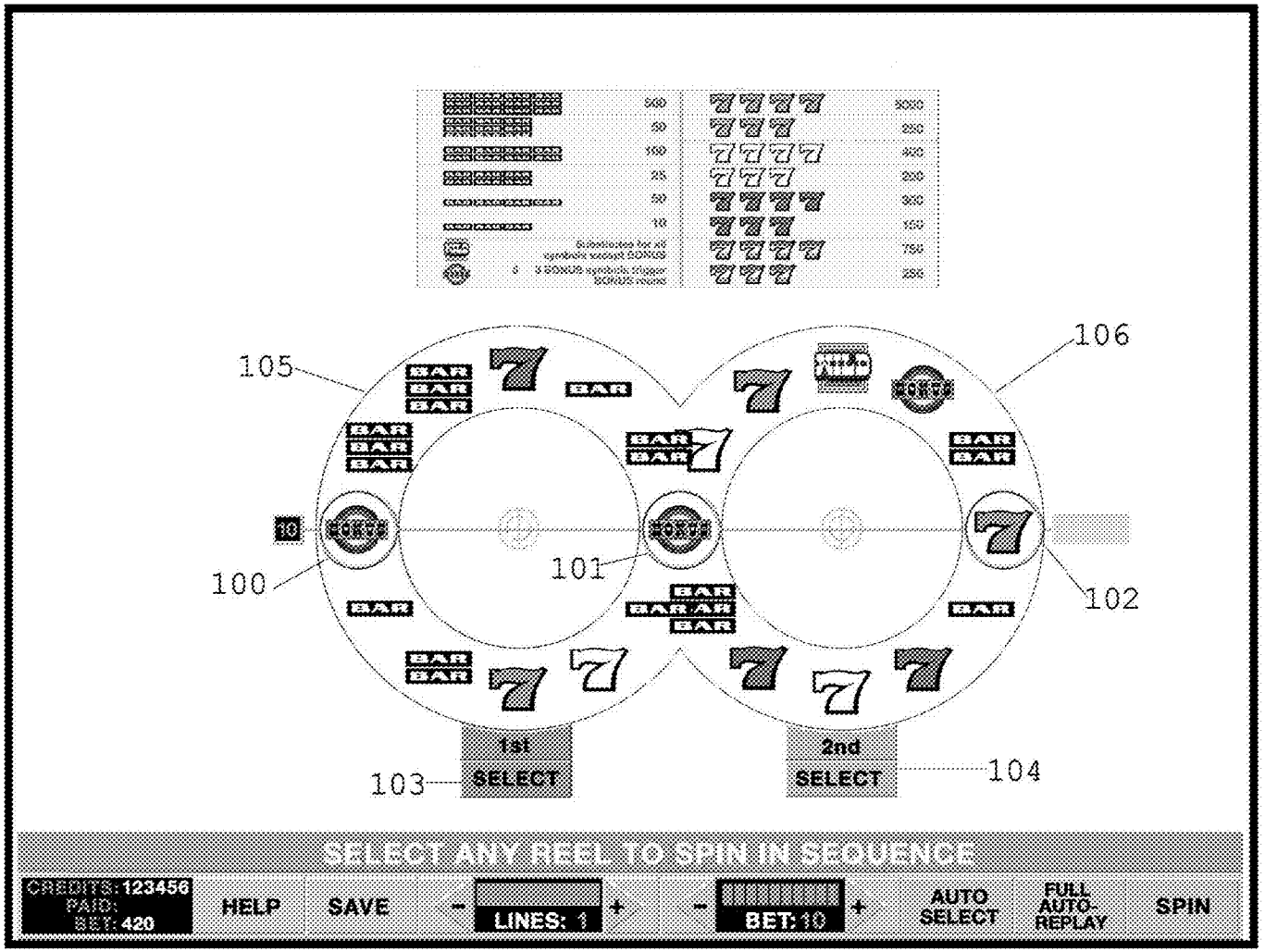
FIG. 1 is a screen shot illustrating a first stage in a two wheel game, according to an embodiment.

Reference will now be made in detail to the presently preferred embodiments of the invention, examples of which are illustrated in the accompanying drawings, wherein like reference numerals refer to like elements throughout.

The present inventive concept relates to a method, apparatus, and computer readable storage medium to implement a slot machine game that uses intersecting wheels that can exchange symbols. Wheels can share a common reel stop and so when a wheel spins it takes whatever symbol happens to be on that reel stop with it. The example configurations in FIGS. 1-17 illustrate the concept. It is noted that the concepts described herein can come in numerous different configurations, and the invention herein is not limited to the specific configurations identified.

FIGS. 1-5 illustrate a time sequence of one particular configuration in order to illustrate the concept.

FIG. 1 is a screen shot illustrating a first stage in a two wheel game, according to an embodiment.

This configuration uses two wheels, a left wheel 105 and a right wheel 106. A three symbol payline is used comprising a first payline position 100, a second payline position 101, and a third payline position 102. Thus, the symbols in these three payline positions combine to form a combination (when the game is completed), and if the combination is a winning combinations (using a paytable) then the player is paid a respective amount. Current, the symbol in the first payline position 100 is "bonus", the symbol in the second payline position 101 is "bonus" and the symbol in the third payline position 102 is "7". Since the player is beginning a new game these three symbols are not particularly relevant (but they were of course relevant in the previous game though).

The player makes a wager, which is done as known in the art by initially depositing cash, a cashless voucher, or electronic funds or other deposit method which then converts the money into playable credits. By pressing buttons on the display (such as physical buttons and/or a touch-screen display), the player can designate the player's desire to wager those credits and initiate a game. In this example, the player designates a wager amount of 10 and presses the spin button. The wheels can either spin from left to right, or optionally the player can choose the order in which the wheels spin by selecting which wheel to spin first (using the select buttons 103 104).

It is noted that each wheel in FIG. 1 appears to have 12 symbols, however this is not exactly accurate because there are only 23 symbols altogether. The second payline position 101 (with the symbol "bonus") is an intersecting position and thus the "bonus" symbol really belongs to both the left wheel 105 and the right wheel 106.

Figure 2:
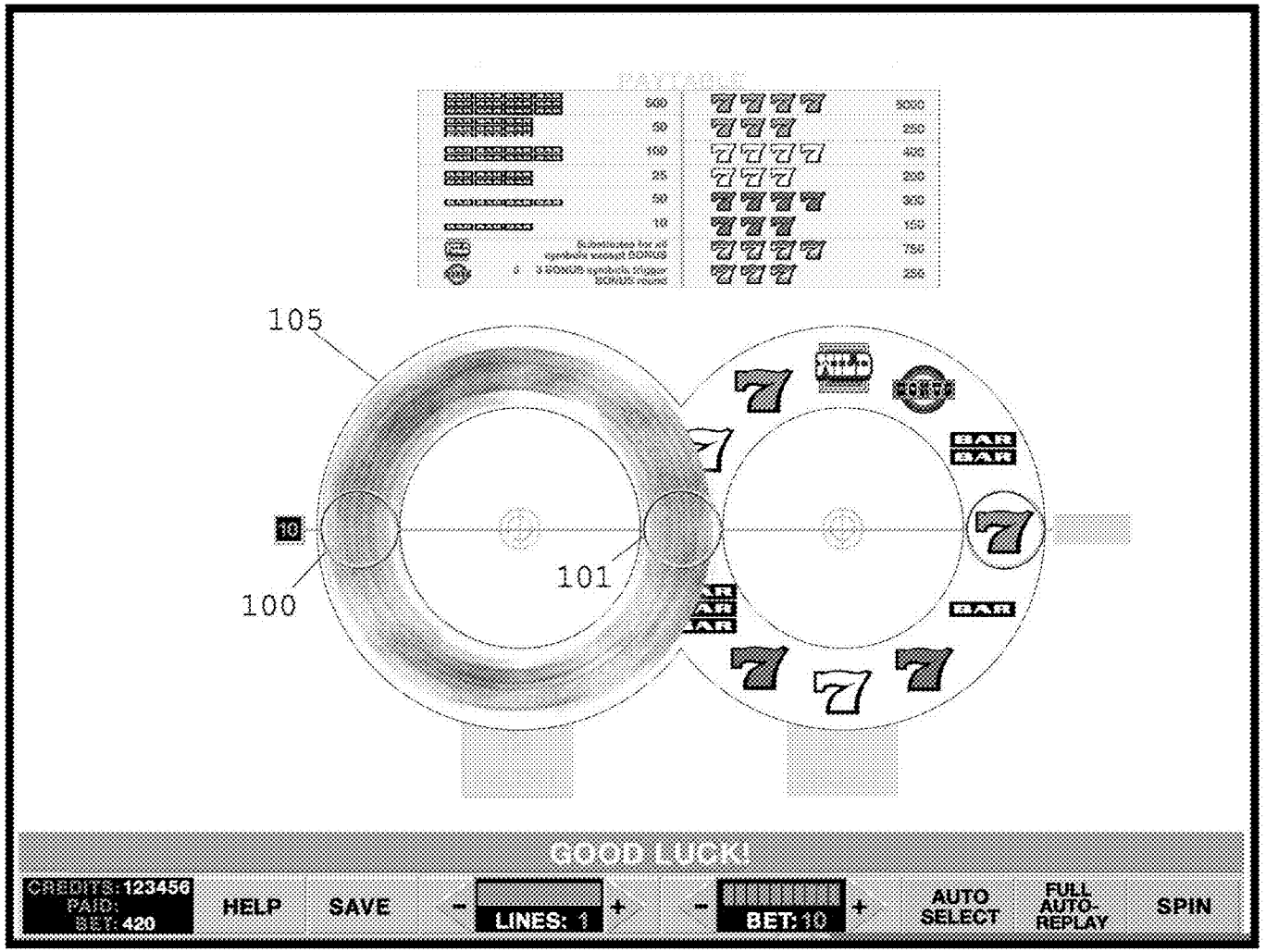
FIG. 2 is a screen shot illustrating a second stage in the two wheel game, according to an embodiment.

FIG. 2 is a screen shot illustrating a second stage in the two wheel game, according to an embodiment.

After the player presses the spin button in FIG. 1, the left wheel 105 spins. There is no symbol in the first payline position 100 or the second payline position 101 since the left wheel 105 is spinning. It is noted that the symbol that was previously in the second payline position 101 before the spin (the "bonus" symbol) now spins with the left wheel 105.

Figure 3:
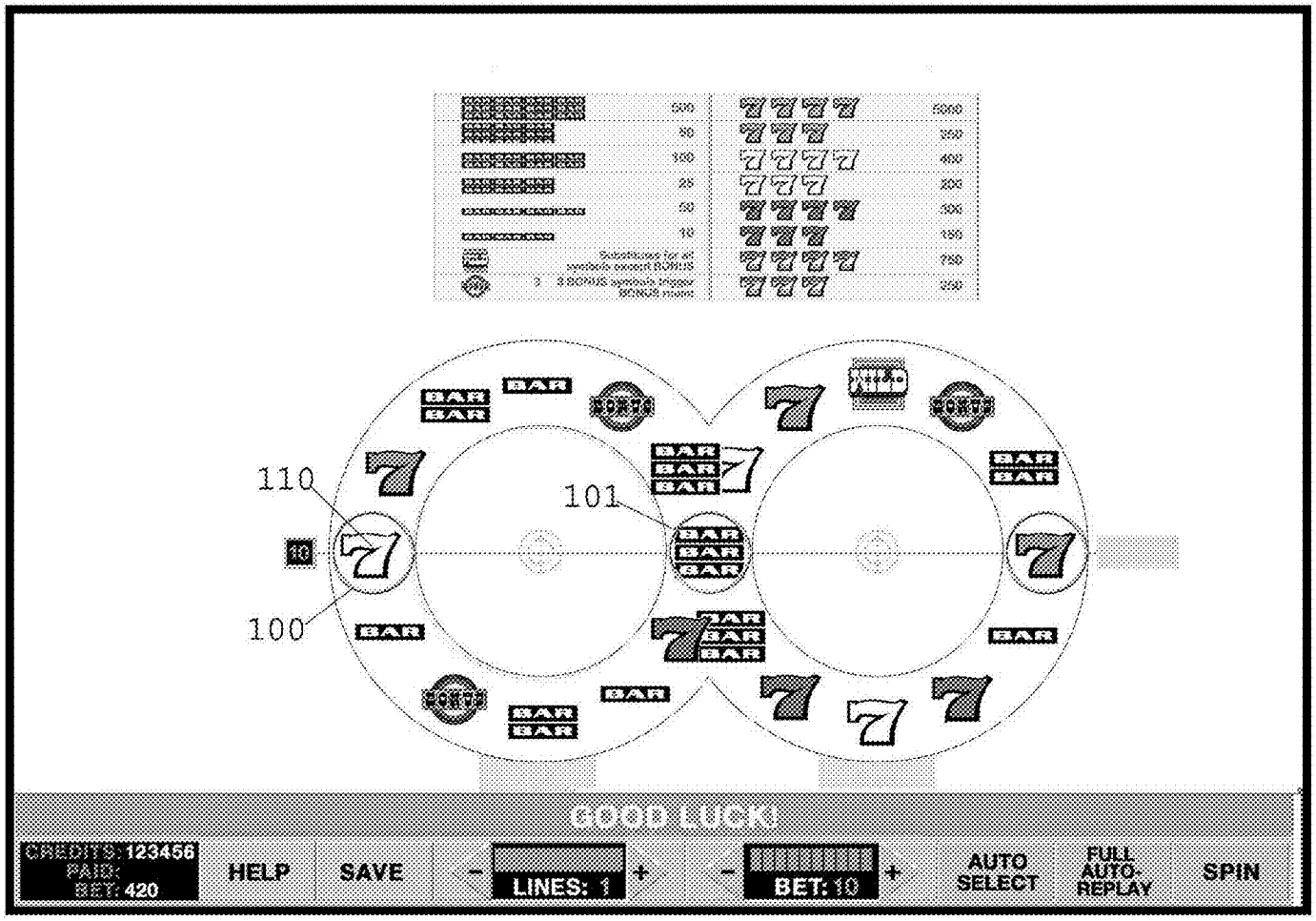
FIG. 3 is a screen shot illustrating a third stage in the two wheel game, according to an embodiment.

FIG. 3 is a screen shot illustrating a third stage in the two wheel game, according to an embodiment.

After a short period of time (e.g., one half second or other amount), the left wheel stops spinning. The first payline position 100 now shows a symbol of "white 7" 110. Note that the left wheel has two "bonus" symbols, which is of course the same number of bonus symbols as before the left wheel started spinning.

Figure 4:
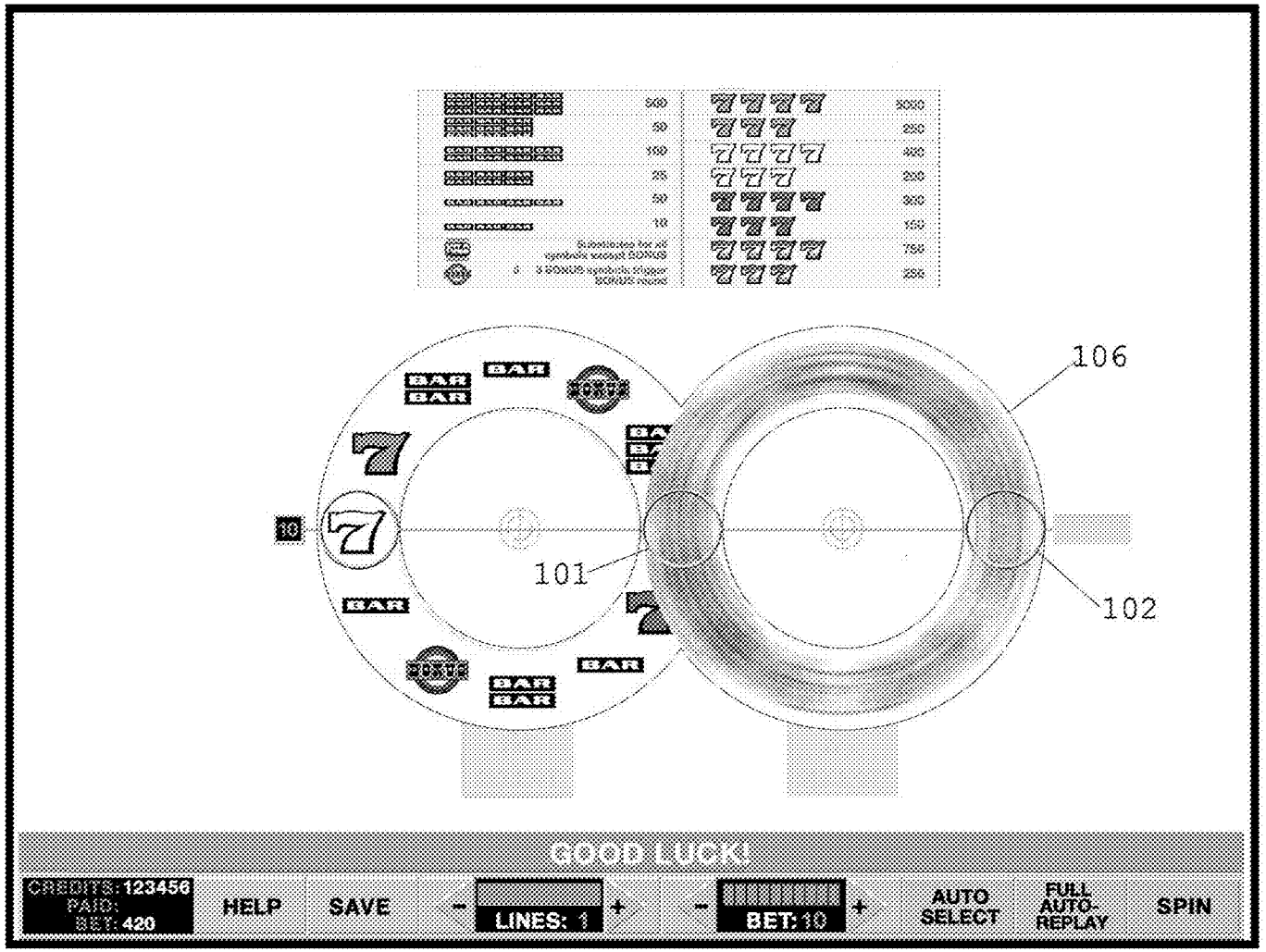
FIG. 4 is a screen shot illustrating a fourth stage in the two wheel game, according to an embodiment.

The second payline position 101 shows a "triple bar" symbol, although this symbol is not relevant because the right wheel will spin in a short duration of time (e.g., one half second) as shown in FIG. 4.

FIG. 4 is a screen shot illustrating a fourth stage in the two wheel game, according to an embodiment.

The right wheel 106 is now spinning. Note that no symbol appears in the second payline position 101 or the third payline position 102 because the right wheel 106 is spinning. After a short duration for the spin (e.g., one half second), then the right wheel comes to a stop as illustrated in FIG. 5.

Figure 5:
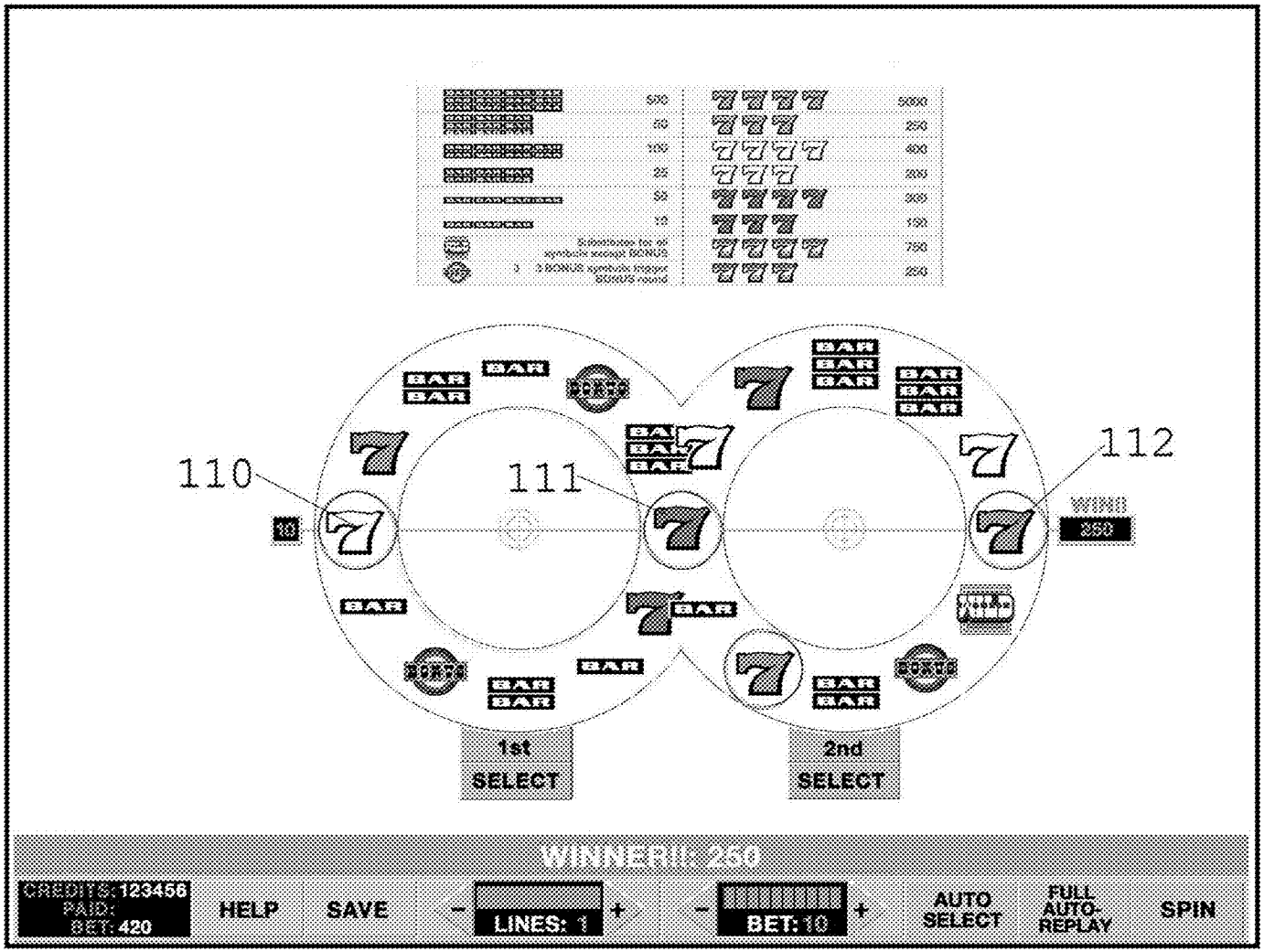
FIG. 5 is a screen shot illustrating a fifth stage in the two wheel game, according to an embodiment.

FIG. 5 is a screen shot illustrating a fifth stage in the two wheel game, according to an embodiment.

The right wheel has now stopped spinning and the game is over. The symbol in the first payline position is a "white" 7 110, the symbol in the second payline position is a "red seven" 111 and the symbol in the third payline position is a "red seven 11. According to the paytable on top of FIG. 5, "any seven/any seven/any seven pays 250 which is what the player wins.

Note that before the game began (in FIG. 1), the left wheel had two triple bar symbols and the right wheel had one triple bar symbol. Now in FIG. 5, after both wheels have spun, note that the left wheel has only one triple bar symbol and the right wheel has two triple bar symbols. This is because one of the triple bar symbols has been "transferred" when the right wheel has spun, taking the triple bar symbol (in the second payline position 101 in FIG. 3) with it. Thus, the second payline position 103 can be considered an "intersecting position" because it falls on more than one wheel, which allows symbols stopping on it to be transferred to different wheels. It is noted that two wheels with an intersection position cannot spin simultaneously, but wheels that do not have an intersection position can spin simultaneously.

FIG. 6-17 illustrate various other configurations of wheels. Of course, it can be appreciated that many other configurations can be implemented as well and these are just some examples. Many of the wheels in the following examples have intersecting positions (or intersection position) wherein symbols on the intersecting position spin with each of the connected wheels when that wheel spins. Thus, symbols can be transferred from a first wheel to a second wheel if the first wheel and the second wheel have an intersecting position (as illustrated in FIG. 1-5). In other words, an intersection position does not really belong to a single wheel but instead belongs to both (or more) wheels that the intersection position is located on.

Figure 6:
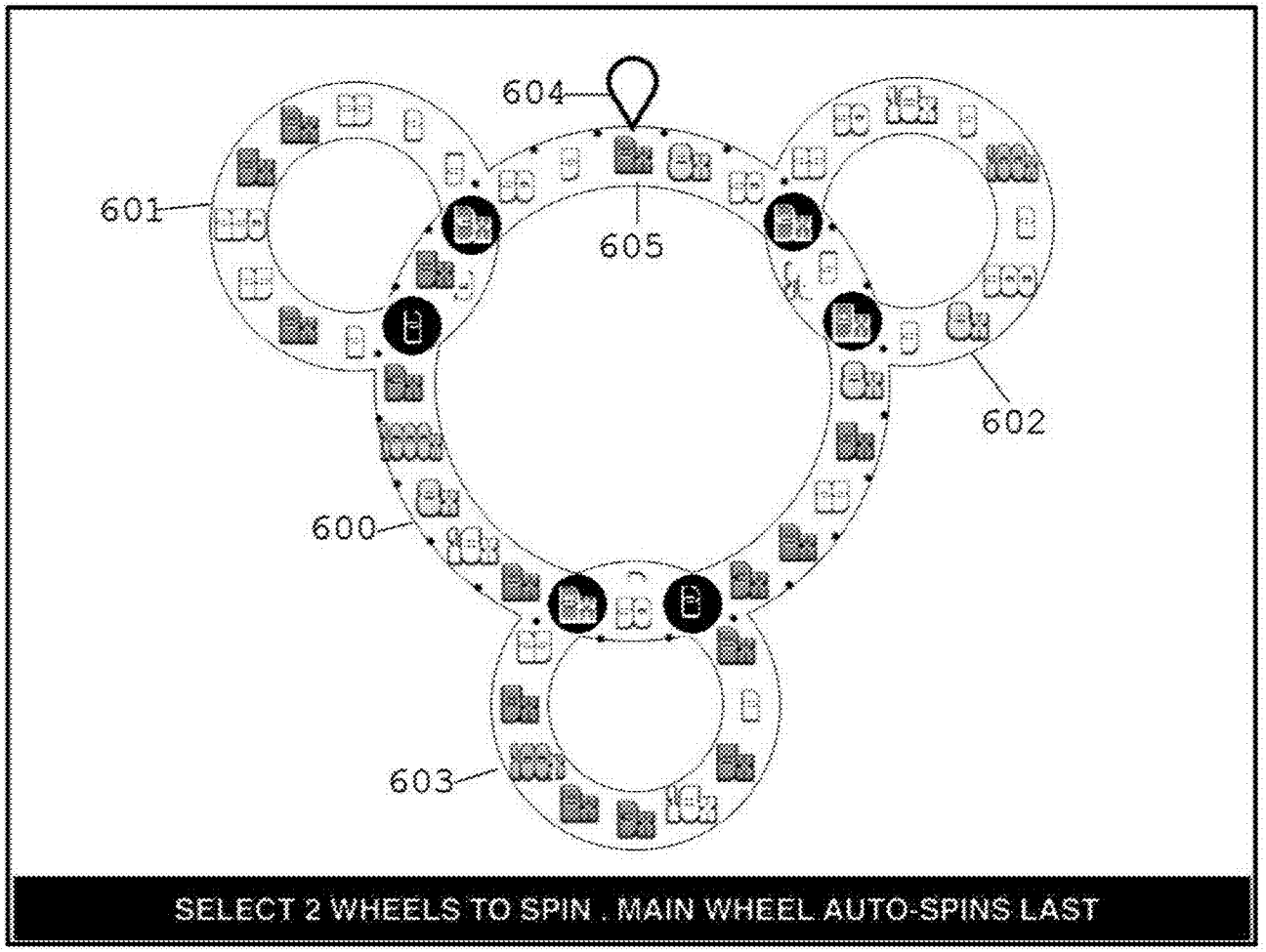
FIG. 6 is a screen shot illustrating a four wheel game, according to an embodiment.

FIG. 6 is a screen shot illustrating a four wheel game, according to an embodiment.

This four wheel game is used to bet on a single payline position 605 which is directly under a pointer 604. This payout structure is similar a wheel structure such as the "big 6" which spins a wheel with symbols on the wheel and a payout is determined based on a single symbol which stops in a particular position. In this example, this configuration is determining a multiplier which can be used to multiply any other award (e.g., this is a bonus round to determine a multiplier amount for a value in a slot machine game, etc.)

A first wheel 601, a second wheel 602, a third wheel 603, and a fourth wheel 600 are part of the configuration. The player can select any one or more of the wheels in the player's desired sequence. If there are no intersection conflicts, then multiple wheels can spin simultaneously. For example, wheels 601, 602, and 603 can spin simultaneously. However, wheel 600 cannot spin simultaneously with any of the other wheels because wheel 600 has intersecting symbols with all three of the other wheels.

It is noted that the first wheel 601, the second wheel 602, and the third wheel 603 each have two intersecting positions with the fourth wheel 600 (thus the fourth (bigger) wheel 600 has six intersecting positions). The six intersection positions in FIG. 6 are highlighted in black. Thus, for example a particular symbol on an intersecting position falling on the first wheel 601 and the fourth wheel 600, when the fourth wheel 600 is spun, can result in the particular symbol ending up on an intersecting position between the third wheel 603 and the fourth wheel 600. If the third wheel 603 is then spun, the particular symbol can end up on a different position on the third wheel 603 (perhaps in a non-intersection position). Thus, it can be appreciated that continuous spinning of wheels can result in the wheels changing their symbol configuration over time.

In FIGS. 1-17, intersecting positions on intersecting wheels can be identified as positions on two or more wheels that fit exactly on the two or more intersecting wheels and thus do not belong to only one of the wheels.

A typical spin sequence would be that wheels 601, 602, 603 spin simultaneously and the wheel 600 spins to determine the symbol in the single payline position 605. Alternatively, the player can choose to spin one out of wheels 601, 602, 603, and then wheel 600 would spin. Alternatively, the player can choose to make any number of spins of wheels 601, 602 603 and in the player's chosen order, before wheel 600 is spun to determine the final result. The player can indicate his desire of which wheels to spin and in which order by using buttons on a touch-screen display (or simply touching the reels themselves).

Figure 7:
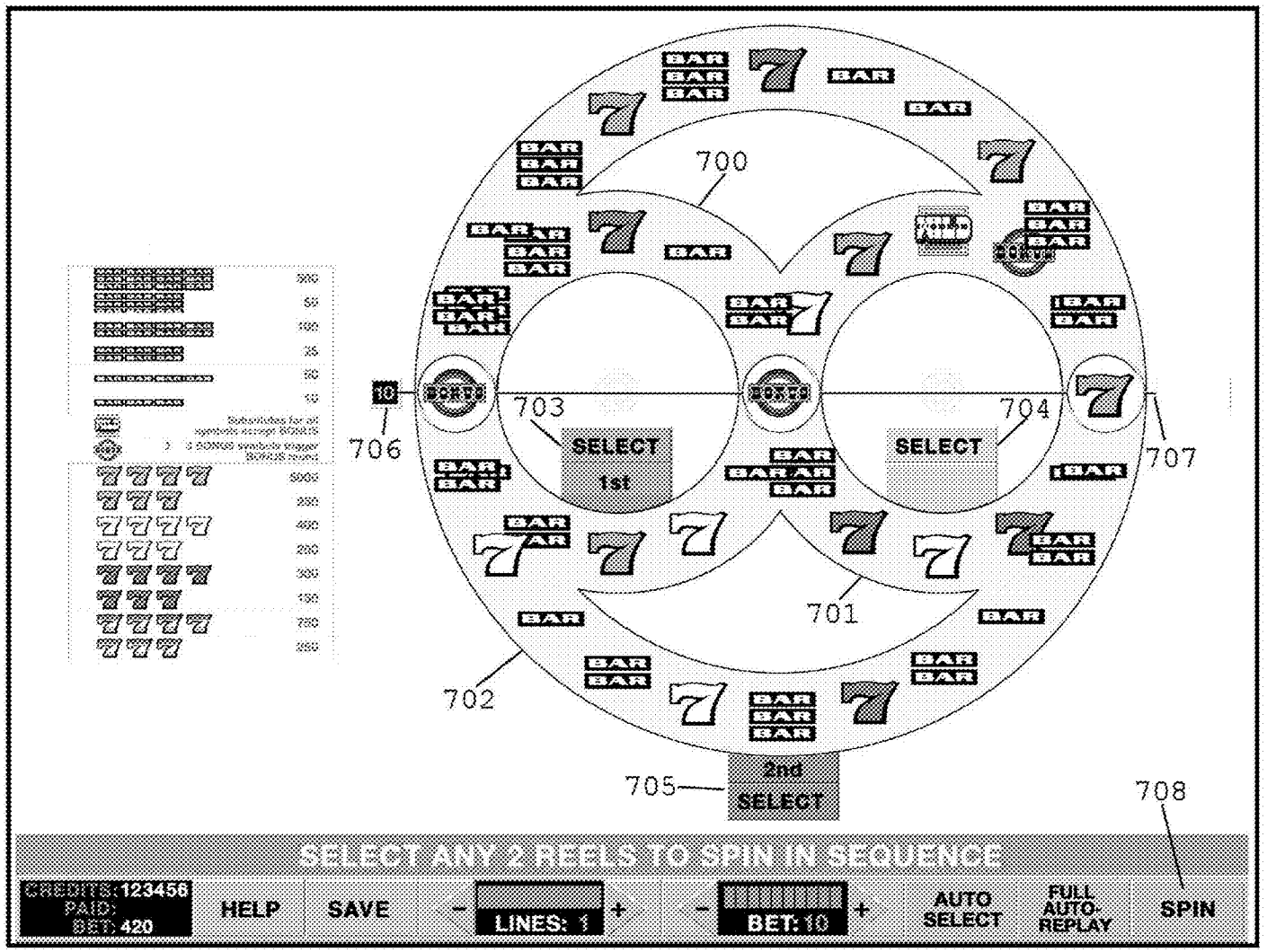
FIG. 7 is a screen shot illustrating three wheel game, according to an embodiment.

FIG. 7 is a screen shot illustrating three wheel game, according to an embodiment.

A first wheel 700, a second wheel 702, and a third wheel 701 can be spun to determine the three symbols on the three symbol payline 707 (currently these symbols are "bonus"," "bonus", "7"). A first select button 703 is used by the player to spin the first wheel 700, a second select button 705 is used by the player to spin the second wheel 702 and a third select button 704 is used by the player to spin the third wheel 701. A bet indicator 706 indicates how many coins (or credits) have been bet (in this case 10). A spin button 708 is used to spin the sequence of reels when the player is ready.

Thus, the player can touch an order of the wheels he or she wishes to spin. In this case, the player touches the first select button 703 first and then the second select button 705 second to designate that the player wants to spin the first wheel 700 first and then the second wheel 702. The player did not press the third select button 704 and thus the player did not wish to spin the third wheel 701. The player is free to choose however many wheels the player wishes to spin and in which order. The player may even be allowed to choose to spin a particular wheel more than once (e.g., spin the first wheel, spin the third wheel, spin the first wheel, and then spin the second wheel).

In FIG. 7 there are three intersecting positions (on the left of the second wheel 702, where the first wheel 700 and the third wheel 701 meet (in the middle), and on the right of the second wheel 702). The symbols in these intersecting positions are "bonus", "bonus", "7" respectively.

Figure 8:
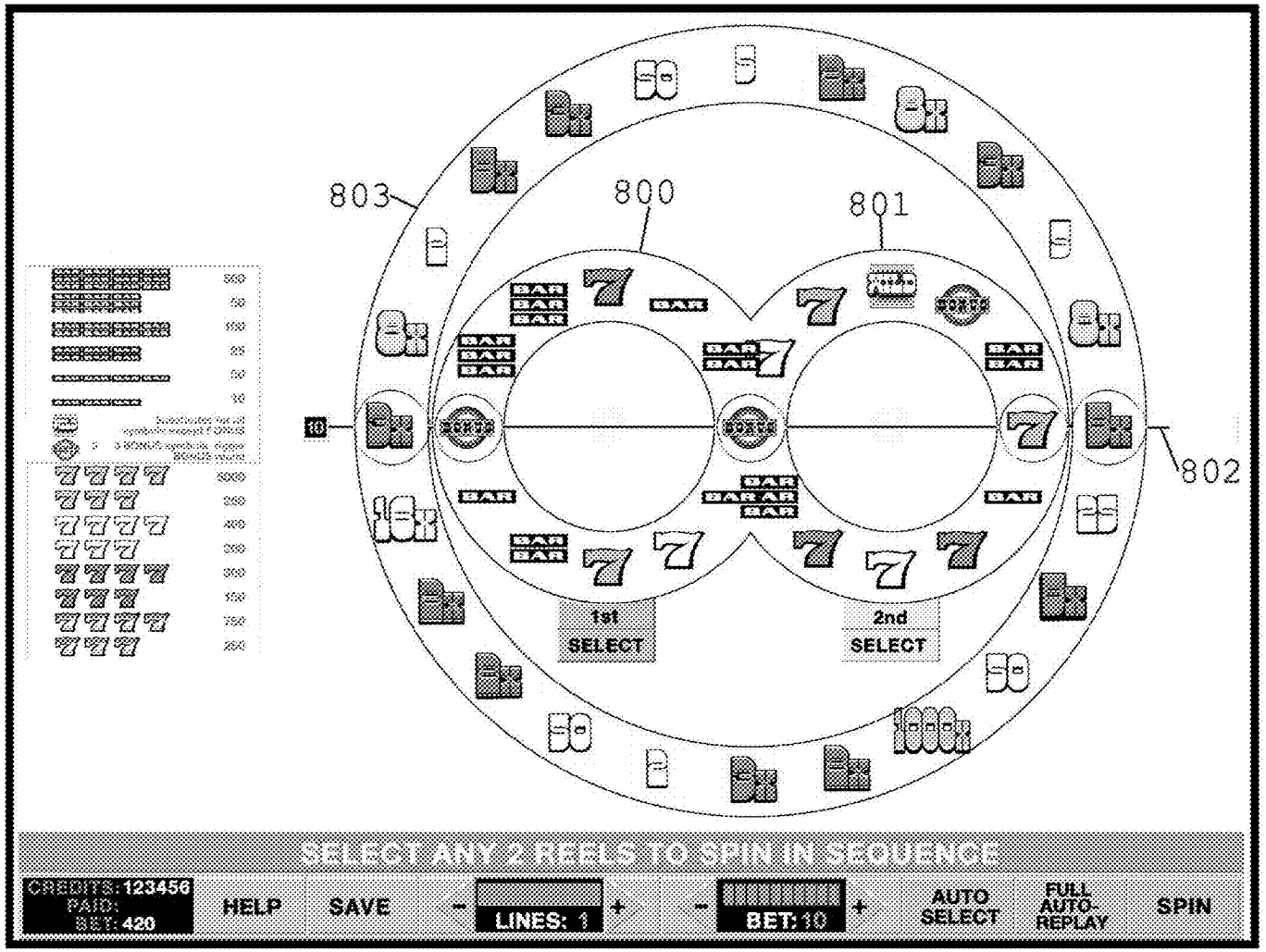
FIG. 8 is a screen shot illustrating another three wheel game, according to an embodiment.

FIG. 8 is a screen shot illustrating another three wheel game, according to an embodiment.

A first wheel 800 and a second wheel 801 can be spun. A bonus wheel 803 is spun if a three symbol combination on the payline 802 (the three symbols only involving the first wheel 800 and the second wheel 801) form a bonus triggering combination, upon which the bonus wheel 803 spins. When the bonus wheel stops spinning, multiplier amounts on the bonus wheel 803 portions of the payline 802 are added to multiply the three symbol award that was earned from the three symbol combination (the three middle symbols) on the payline 802.

Figure 9:
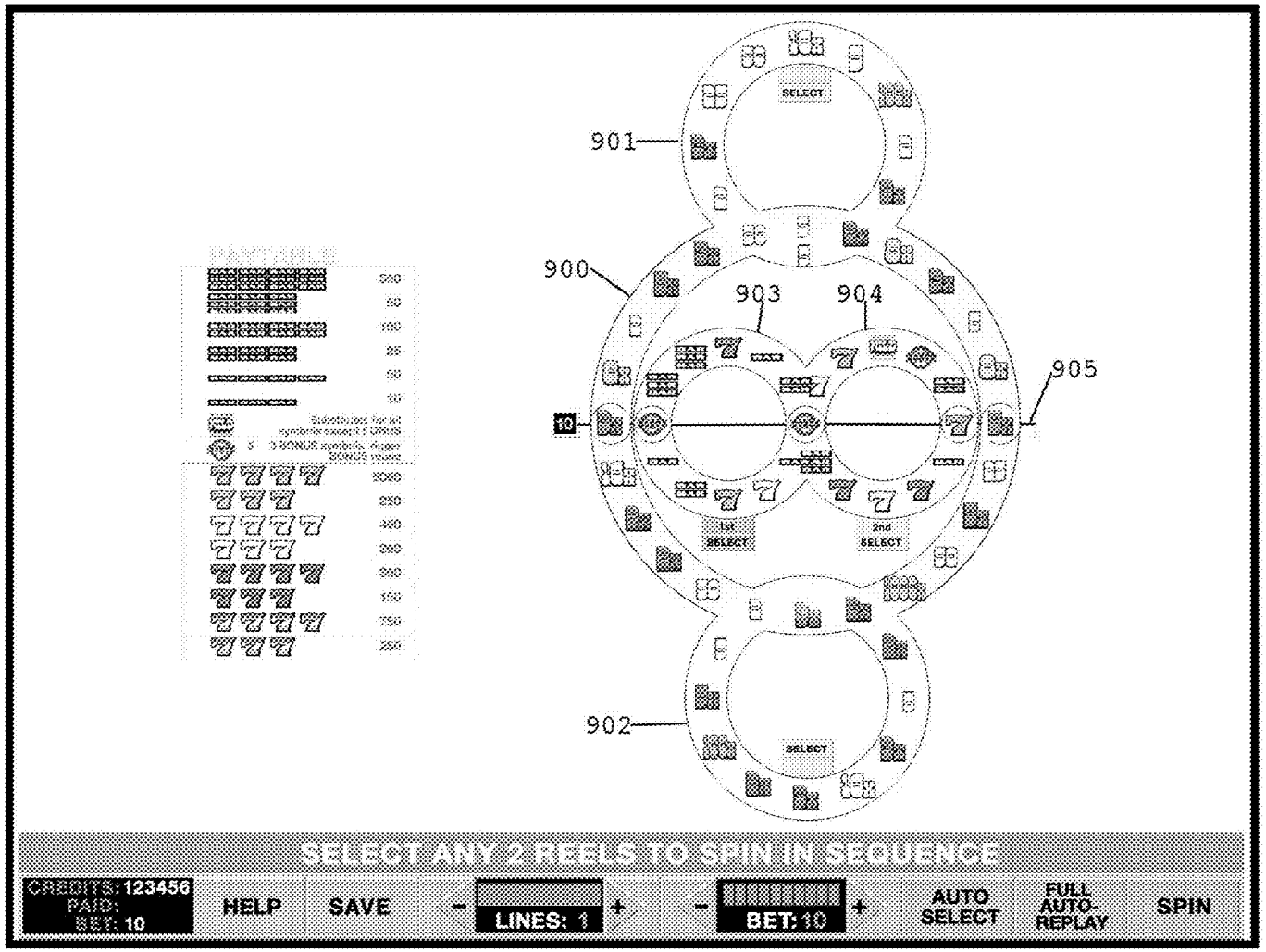
FIG. 9 is a screen shot illustrating a five wheel game, according to an embodiment.

FIG. 9 is a screen shot illustrating a five wheel game, according to an embodiment.

This configuration has two main game wheels and three bonus wheels. First main game wheel 903 and second main game wheel 904 are spun to determine whether the player achieves a three symbol winning combination on payline 905 (the three symbols now are "bonus", "bonus", and "7"). Two or more bonus symbols on the main payline 905 activate a free spin mode that includes the three bonus wheels. The player can elect to spin the top 901 or bottom 902 bonus wheels before the center bonus wheel 900 spins to complete the game.

Figure 10:
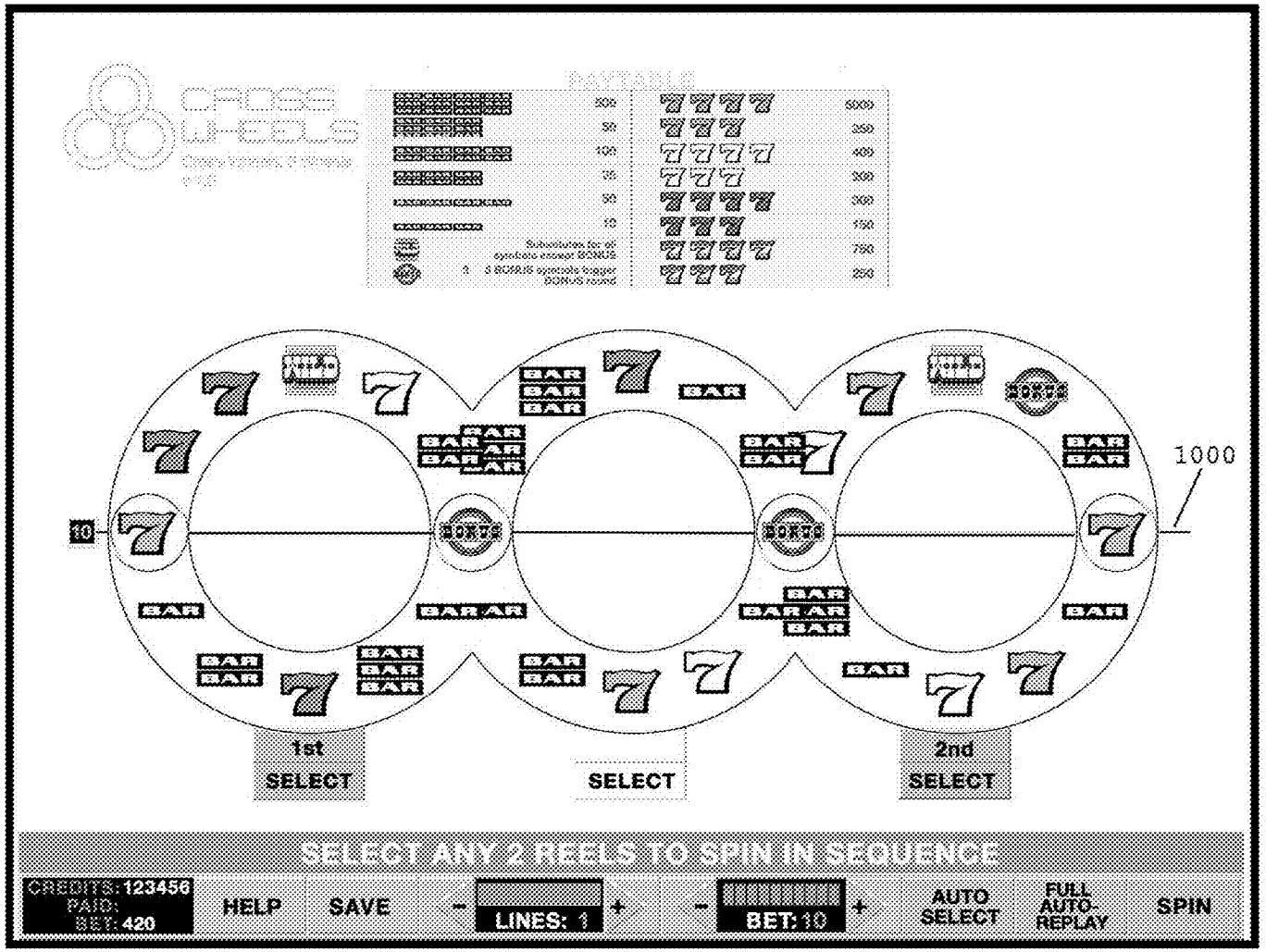
FIG. 10 is a screen shot illustrating a further three wheel game, according to an embodiment.

FIG. 10 is a screen shot illustrating a further three wheel game, according to an embodiment.

Three wheels are used with one four symbol payline 1000. The reels can be spun in any order by the player.

Figure 11:
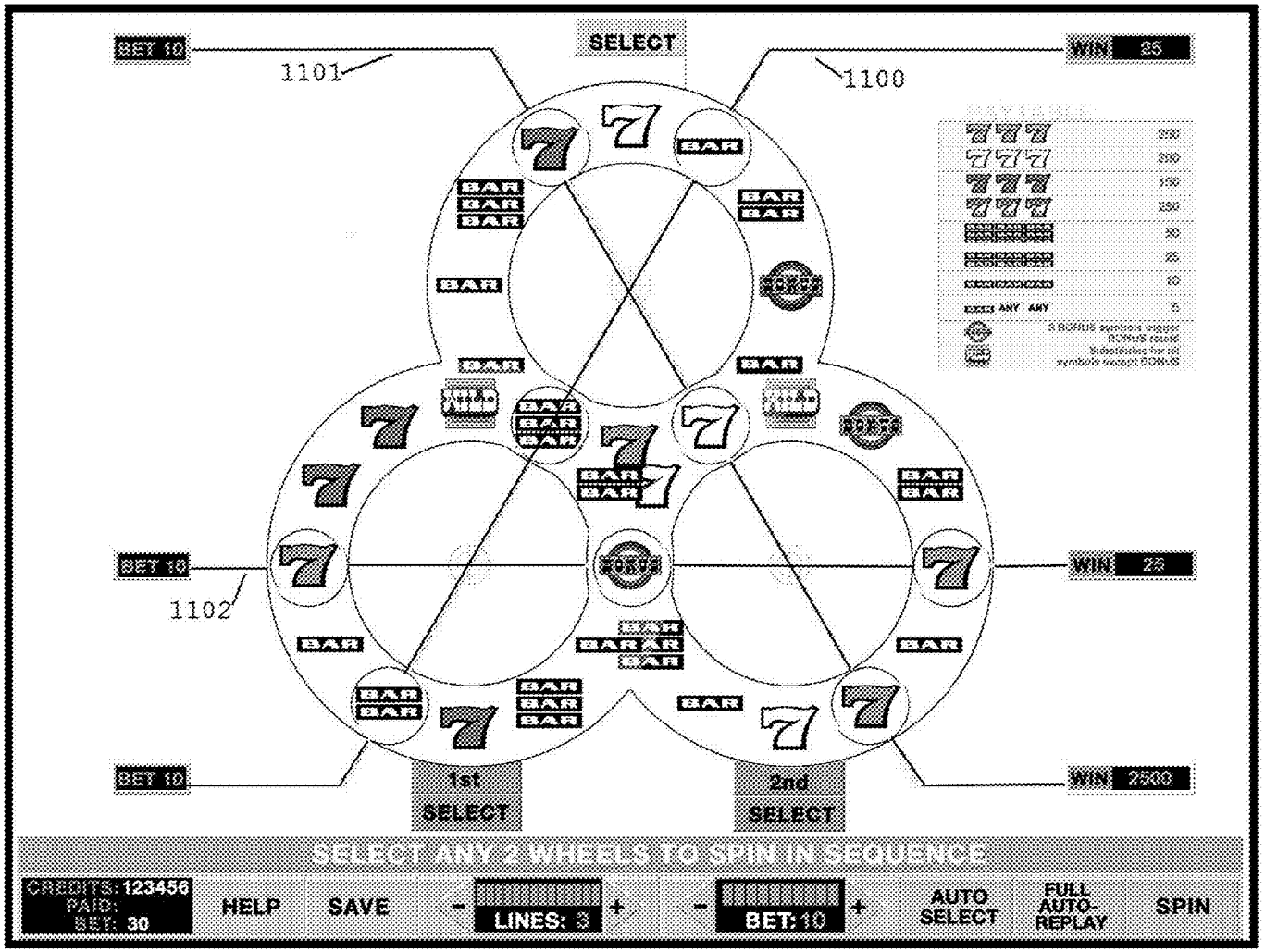
FIG. 11 is a screen shot illustrating another an additional three wheel game, according to embodiment.

FIG. 11 is a screen shot illustrating another an additional three wheel game, according to embodiment.

Three wheels are used with three symbol paylines 1100, 1101, 1102. The player can select to spin two wheels in any sequence. Alternatively, the player can select to spin all three wheels in any sequence, or the player can be allowed to spin any number of wheels any number of times in any sequence.

Figure 12:
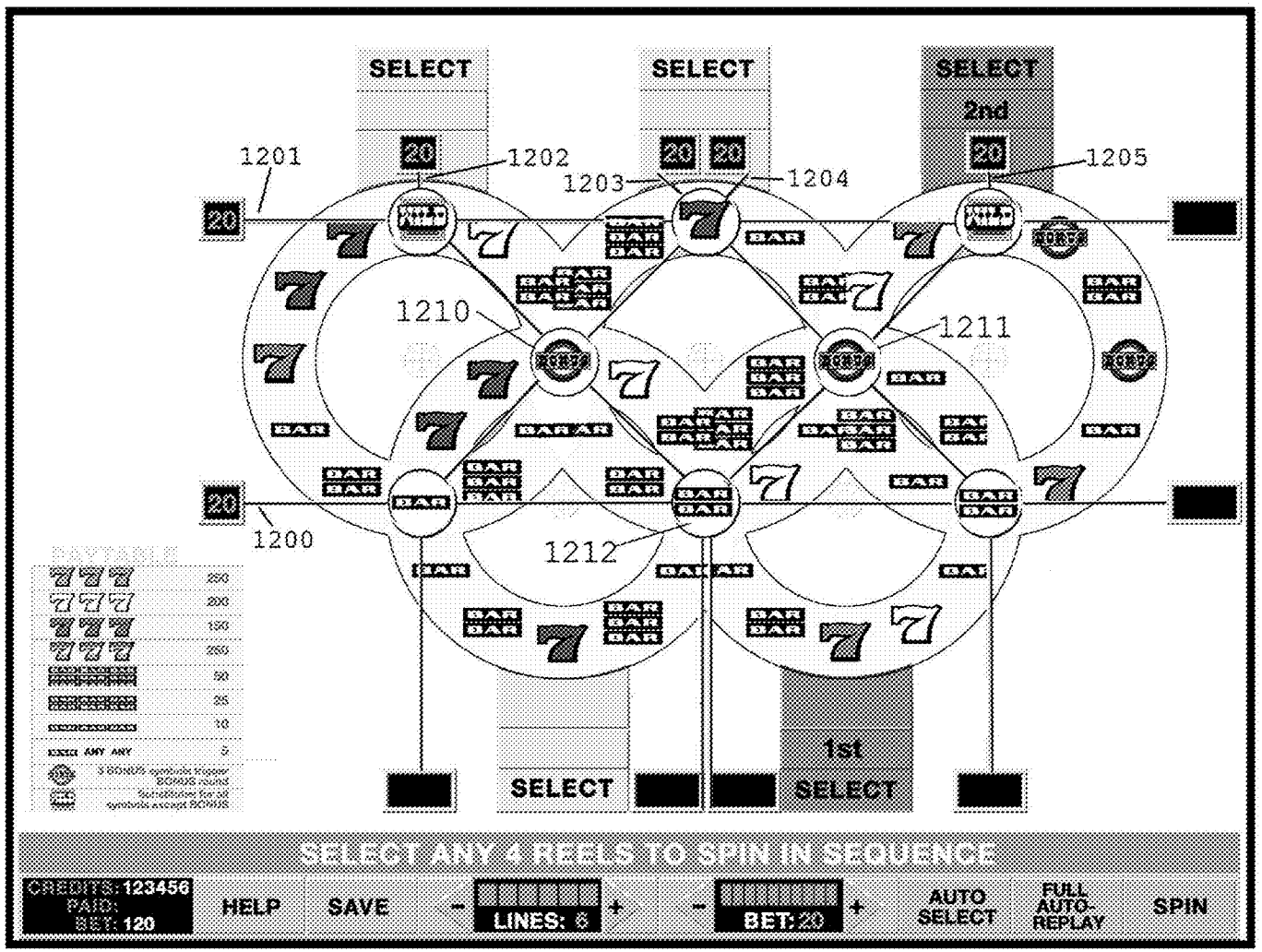
FIG. 12 is a screen shot illustrating another five wheel game, according to an embodiment.

FIG. 12 is a screen shot illustrating another five wheel game, according to an embodiment.

This is a configuration with five wheels and six paylines 1200, 1201, 1202, 1203, 1204, and 1205. In this particular example, the player has bet 20 coins on each line therefore betting 120 coins on the game.

It is noted that this configuration contains three "triply-intersecting" positions 1210, 1211, 1212 that each have three respective intersecting wheels. Thus, the three wheels that intersect with these positions can all exchange symbols therebetween by successive spins of the intersecting wheels.

Figure 13:
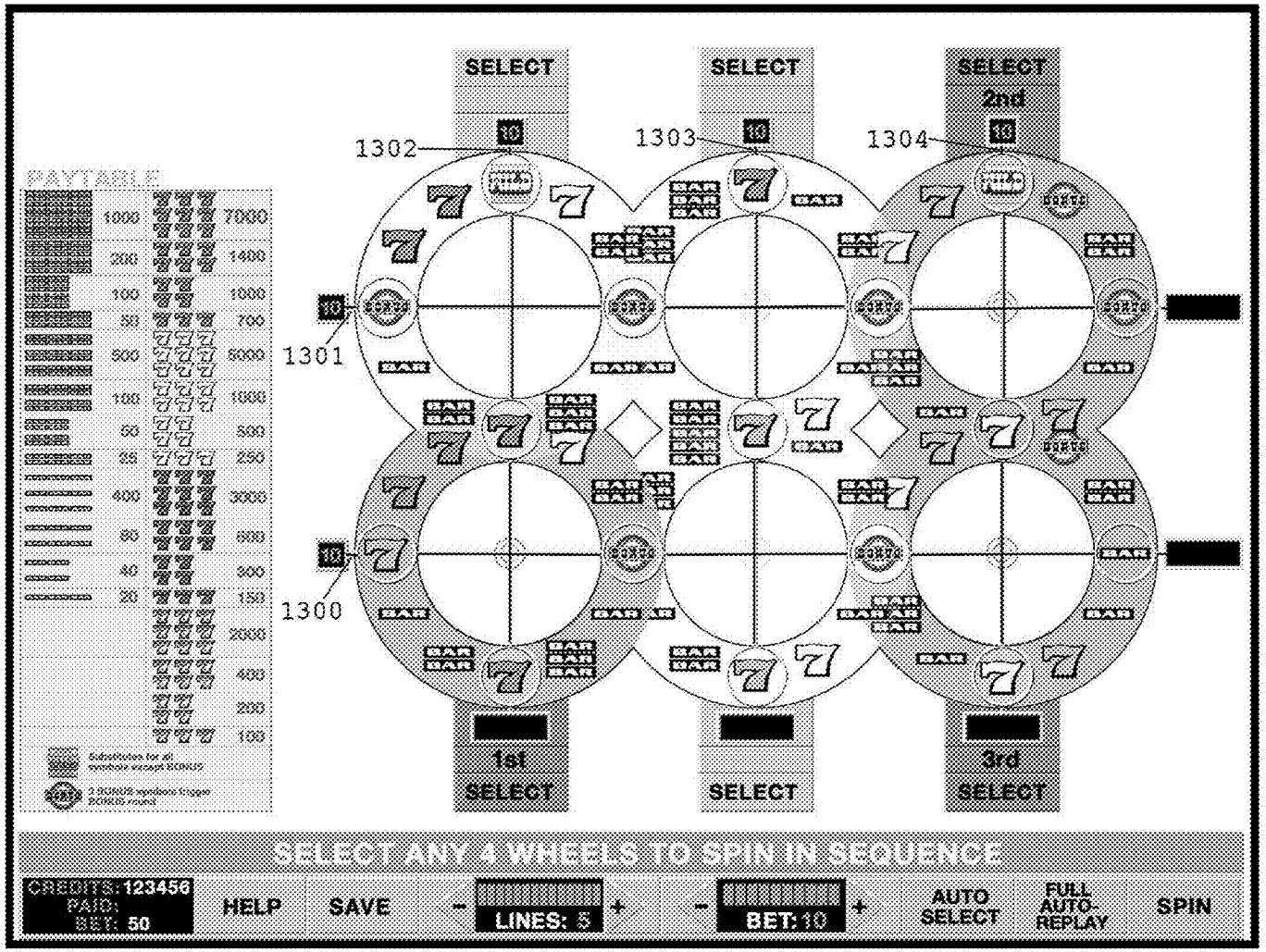
FIG. 13 is a screen shot illustrating a six wheel game, according to an embodiment.

FIG. 13 is a screen shot illustrating a six wheel game, according to an embodiment.

There are two four symbol paylines 1300, 1301 and three symbol paylines 1302, 1303, 1304.

Figure 14:
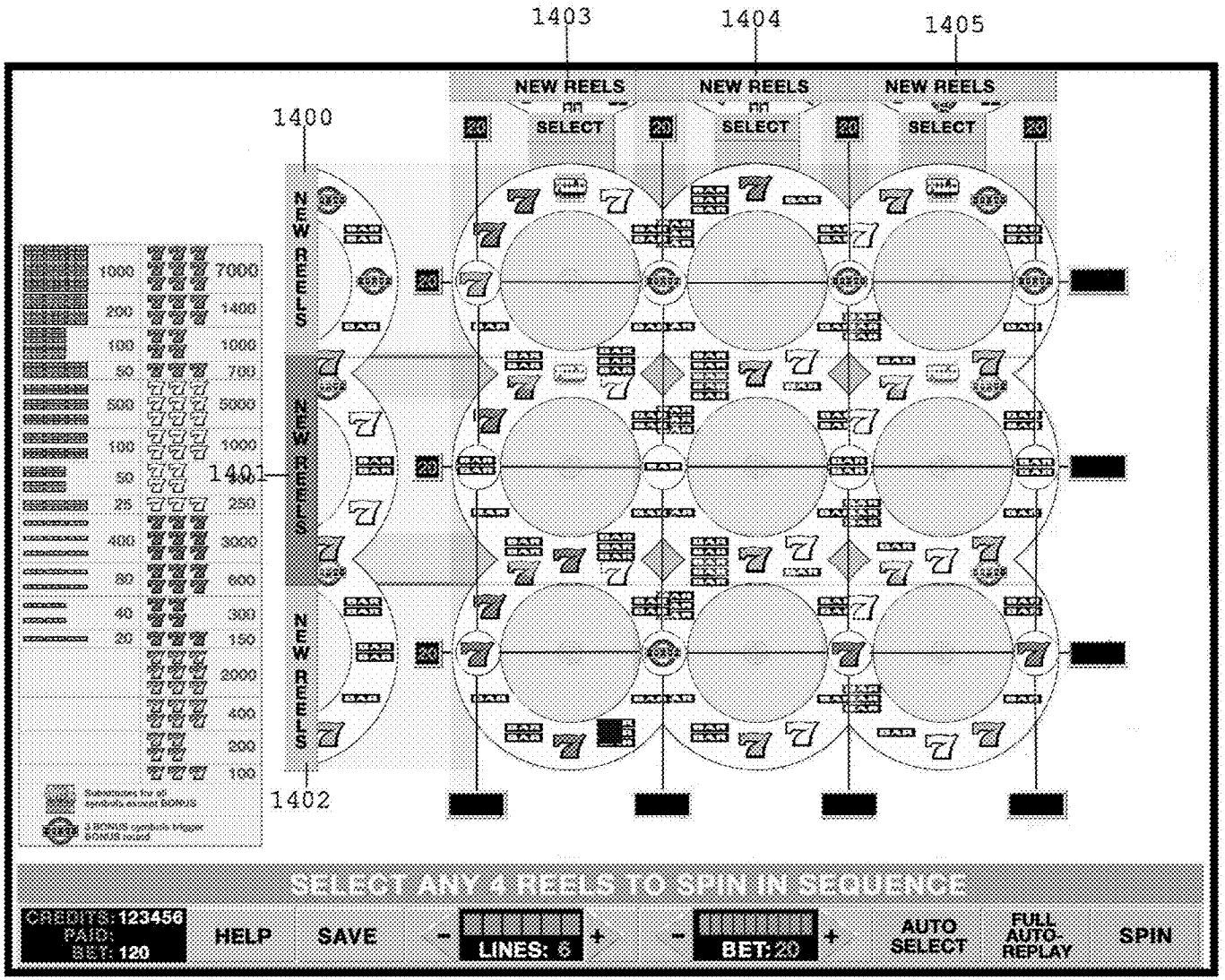
FIG. 14 is a screen shot illustrating a nine wheel game, according to an embodiment.

FIG. 14 is a screen shot illustrating a nine wheel game, according to an embodiment.

This configuration has nine wheels and seven paylines (three four symbol paylines and four three symbol paylines). As an optional feature, the player is able to replace a row or column of wheels at the player's option. For example, if the player is not happy with the top row of the wheels (i.e. the top three wheels) then the player can press top row replace button 1400 which replaces the top three wheels with brand new wheels which typically would have different symbols on each wheel than the wheels being replaced. If the player wants to replace the middle row of wheels then the player can press middle row replace button 1401 which would replace the middle row of wheels with new wheels which typically would have different symbols on each wheel than the wheels being replaced. If the player wants to replace the bottom row of wheels then the player can press bottom row replace button 1402 which would replace the bottom row of wheels with new wheels which typically would have different symbols on each wheel than the wheels being replaced.

If the player is not happy with the first column of the wheels (i.e. the leftmost three wheels) then the player can press left column replace button 1400 which replaces the leftmost column of wheels with brand new wheels which typically would have different symbols on each wheel than the wheels being replaced. If the player wants to replace the middle column of wheels then the player can press middle column replace button 1404 which would replace the middle column of wheels with new wheels which typically would have different symbols on each wheel than the wheels being replaced. If the player wants to replace the rightmost column of wheels then the player can press right column replace button 1405 which would replace the rightmost column of wheels with new wheels which typically would have different symbols on each wheel than the wheels being replaced. The player can press any of the replace buttons before spinning the wheels.

Figure 15:
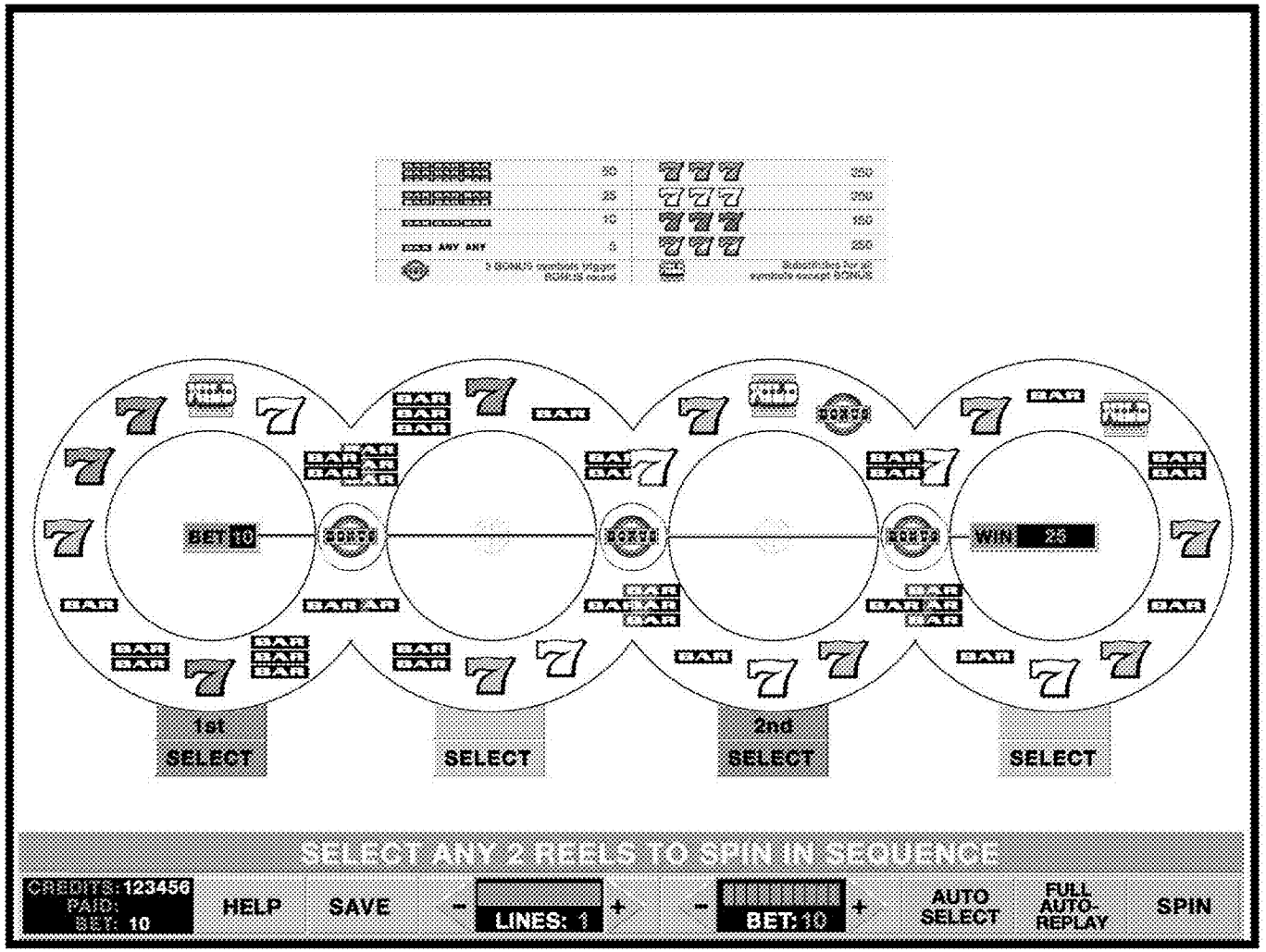
FIG. 15 is a screen shot illustrating another four wheel game, according to an embodiment.

FIG. 15 is a screen shot illustrating another four wheel game, according to an embodiment.

This illustrates a four wheel configuration with one three symbol payline. The player can choose two wheels to spin (and the sequence). Alternatively, the player can choose any number of wheels to spin in any sequence chosen by the player.

Figure 16:
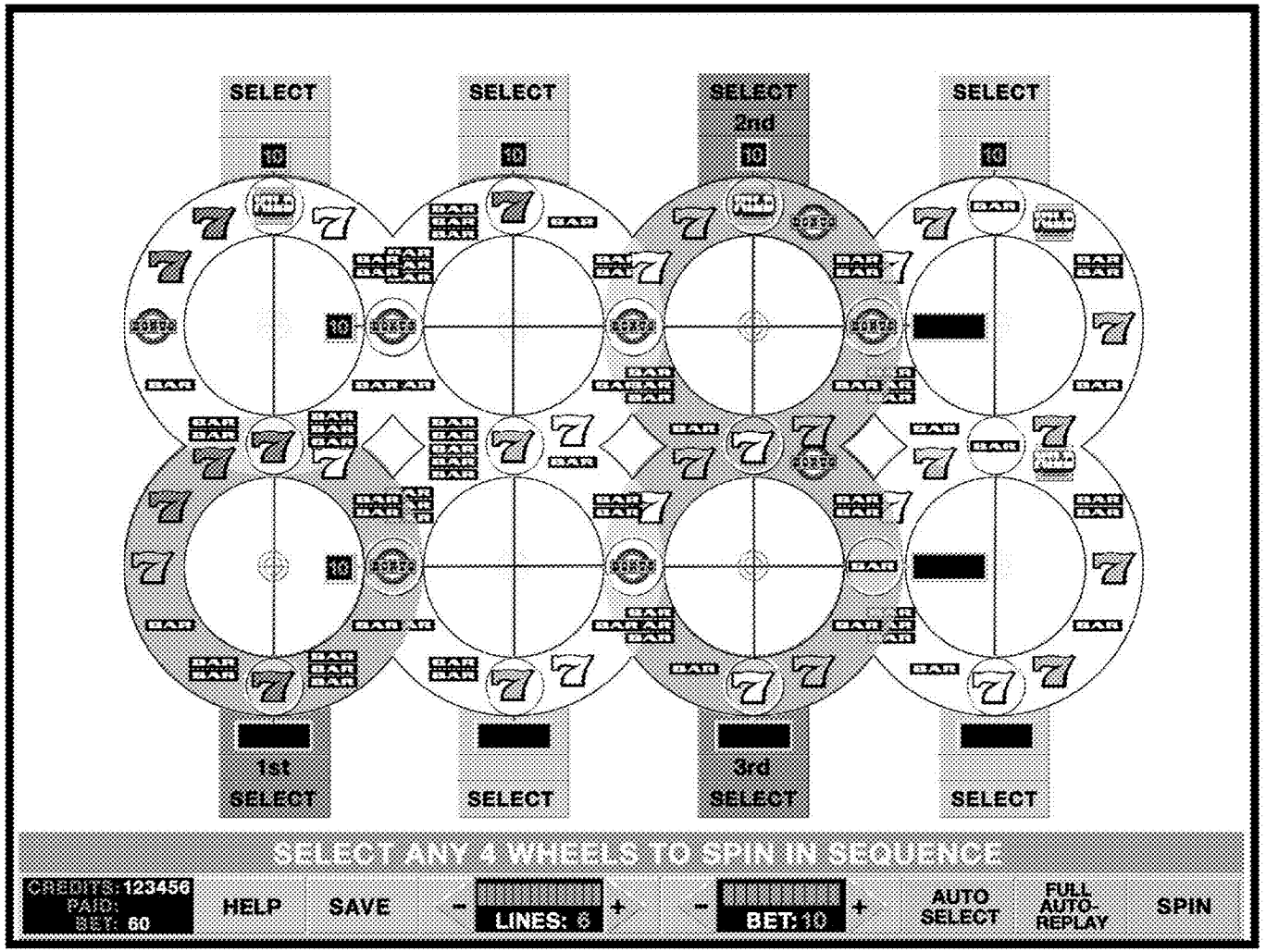
FIG. 16 is a screen shot illustrating an eight wheel game, according to an embodiment.

FIG. 16 is a screen shot illustrating an eight wheel game, according to an embodiment.

This configuration has eight wheels and six three symbol paylines. The player can select which wheels to spin by pressing any of the eight "select" buttons in a same sequence that the player wishes to spin them.

Figure 17:
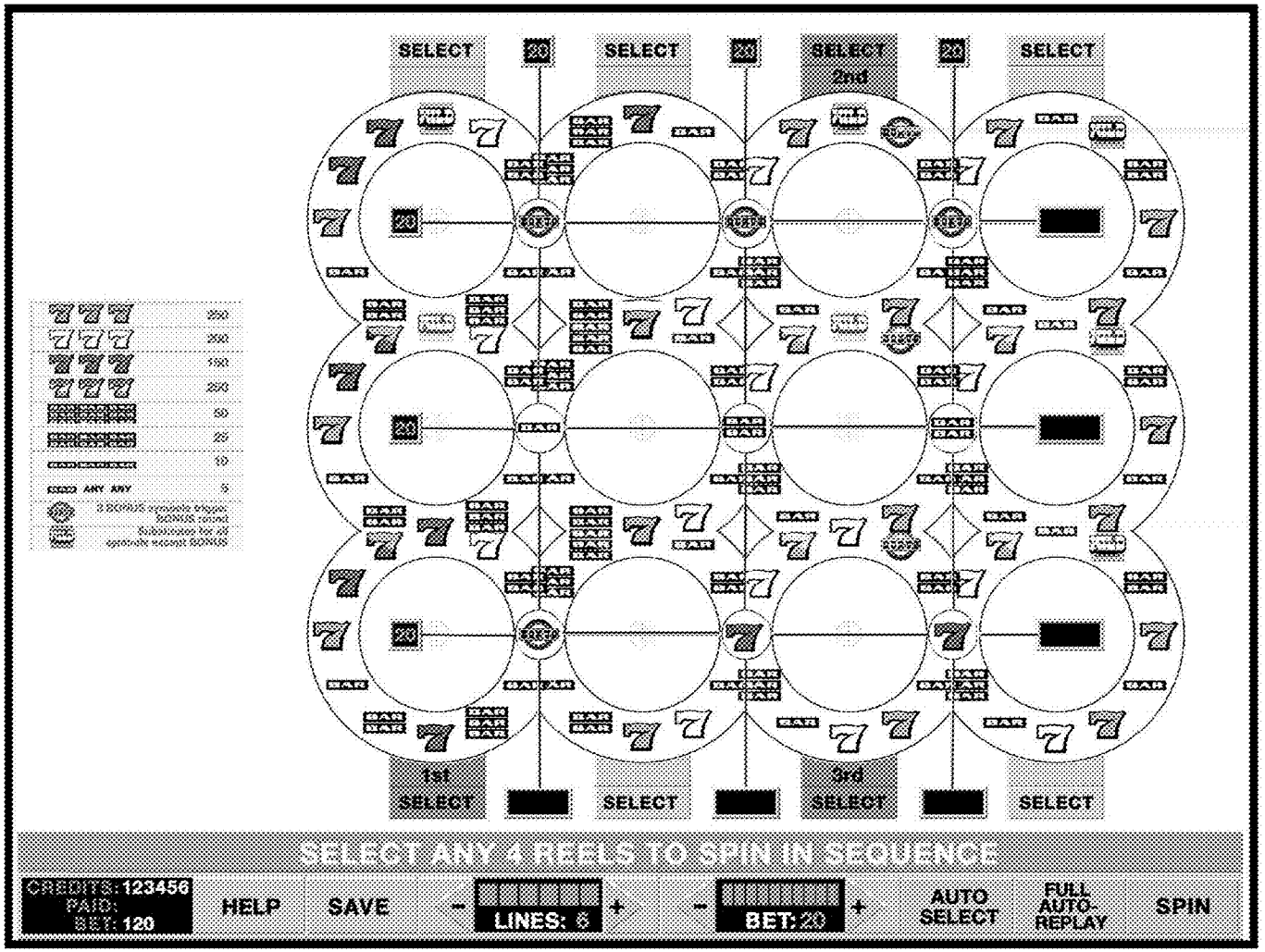
FIG. 17 is a screen shot illustrating a sixteen wheel game, according to an embodiment.

FIG. 17 is a screen shot illustrating a sixteen wheel game, according to an embodiment.

This configuration has twelve wheels and six three symbol paylines.

Figure 18:
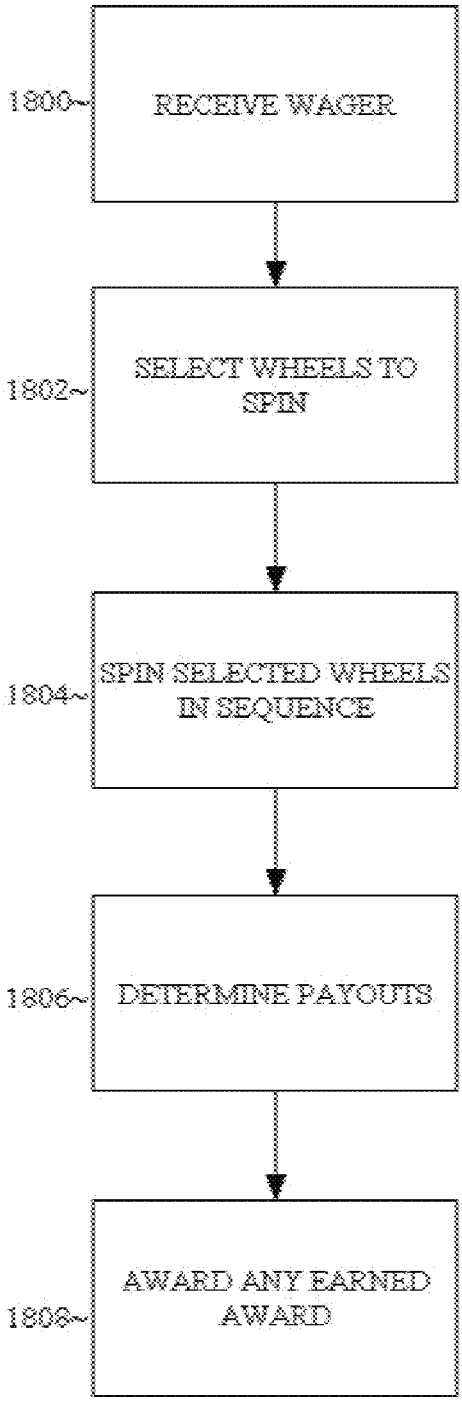
FIG. 18 is a flowchart illustrating an exemplary method of implement a slot game with intersection wheels, according to an embodiment.

FIG. 18 is a flowchart illustrating an exemplary method of implement a slot game with intersection wheels, according to an embodiment.

The method begins with operation 1800, which receives a wager from a player. This can be done as described herein and as known in the art. The player can fund the machine by adding cash, a cashless ticket, or electronic payment. The player can then wager some of those credits for the instant wager.

The player can select which paylines to wager on (if there are more than one) and how many credits to wager on each payline. For example, in a three paylines game, if the player wagers 10 credits on each payline that would be a 30 credit wager for the game.

From operation 1800, the method proceeds to operation 1802, wherein the player selects the wheels on the screen to spin. In some embodiments, all of the wheels will spin before an award is computed. In other embodiments, only some of the wheels will spin. In these embodiments, the player can select which of the wheels (and in the proper sequence) that the wheels will spin.

From operation 1802, the method proceeds to operation 1804, wherein the machine spins the selected wheels in the selected sequence.

From operation 1804, the method proceeds to operation 1806, which after the wheels stop spinning in operation 1804, determine the payouts. All of the symbols located in the active paylines (paylines that the player wagered on in order to earn a payout) are evaluated to see if they form a winning combination based on the currently active paytable.

From operation 1806, the method proceeds to operation 1808, which awards all awards (if any were earned) from operation 1806 to the player. The awards can be paid in cash (coin), or by increasing the player's credit meter (so that the credits can be cashed out at a later point in time).

In a further embodiment, when the player makes wager in operation 1800, an initialization occurs and all of the wheels start from a predetermined configuration (the symbol mapping on each of the wheels resets to the same initial condition). The player can then spin them accordingly. For example, each time the player begins a new game the wheels have the symbols arranges is illustrated in FIG. 10 (or any other figure). The player can spin the wheels (the number of times as dictated by the particular game rules) and receive his or her award (if any), but then upon a new game the wheel mapping reverts to an initial condition. This would prevent the situation from occurring where different new games (with different wagers) would have different house advantages.

In another embodiment, the player can make an initial wager which pays for a predetermined number (e.g., three) games (and the wheel mappings are reverted to an initial configuration), and the wheel mapping does not reset for each of the three games. Once the three games are over, and the player makes a new wager, then the wheel mappings can revert to the initial configuration again. This allows the game to allow some skill by the player (by choosing which wheels and which sequence to spin) while only accepting wagers from an initial configuration.

In another embodiment, the wheels are not reset and continuous play by the player continuously affects the symbol mapping on the wheels, even when one players leaves the machine and another player starts to play at the machine.

Figure 19:
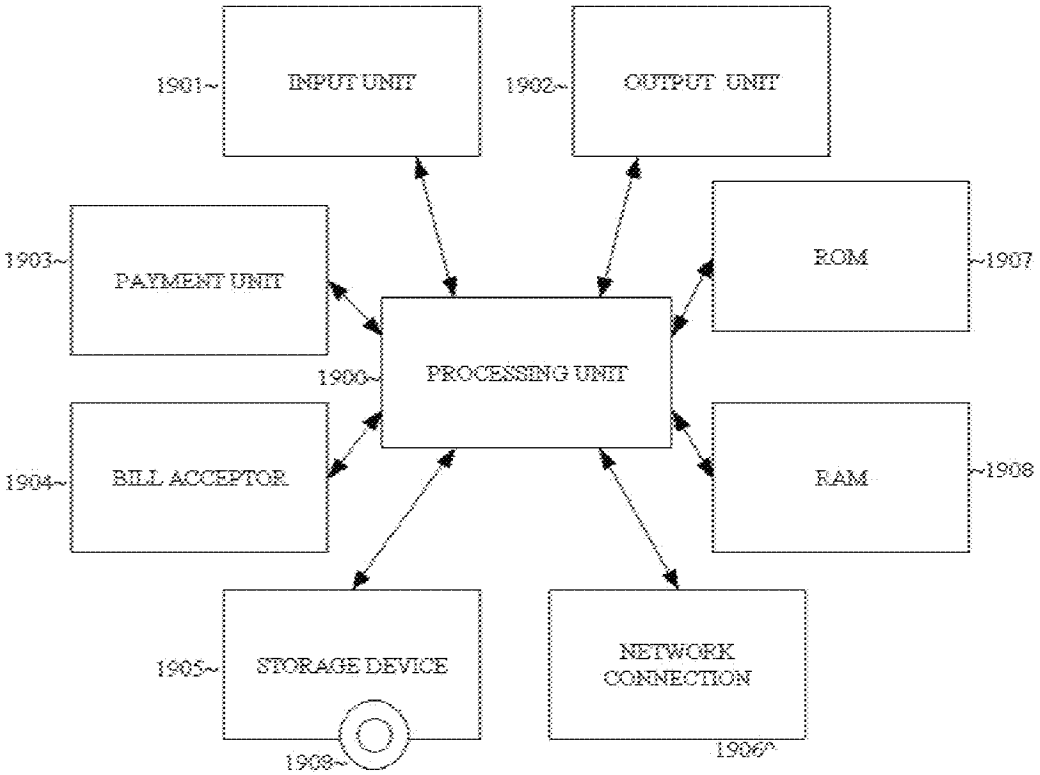
FIG. 19 is a block diagram illustrating hardware that can be used to implement the methods described herein.
Figure 20:
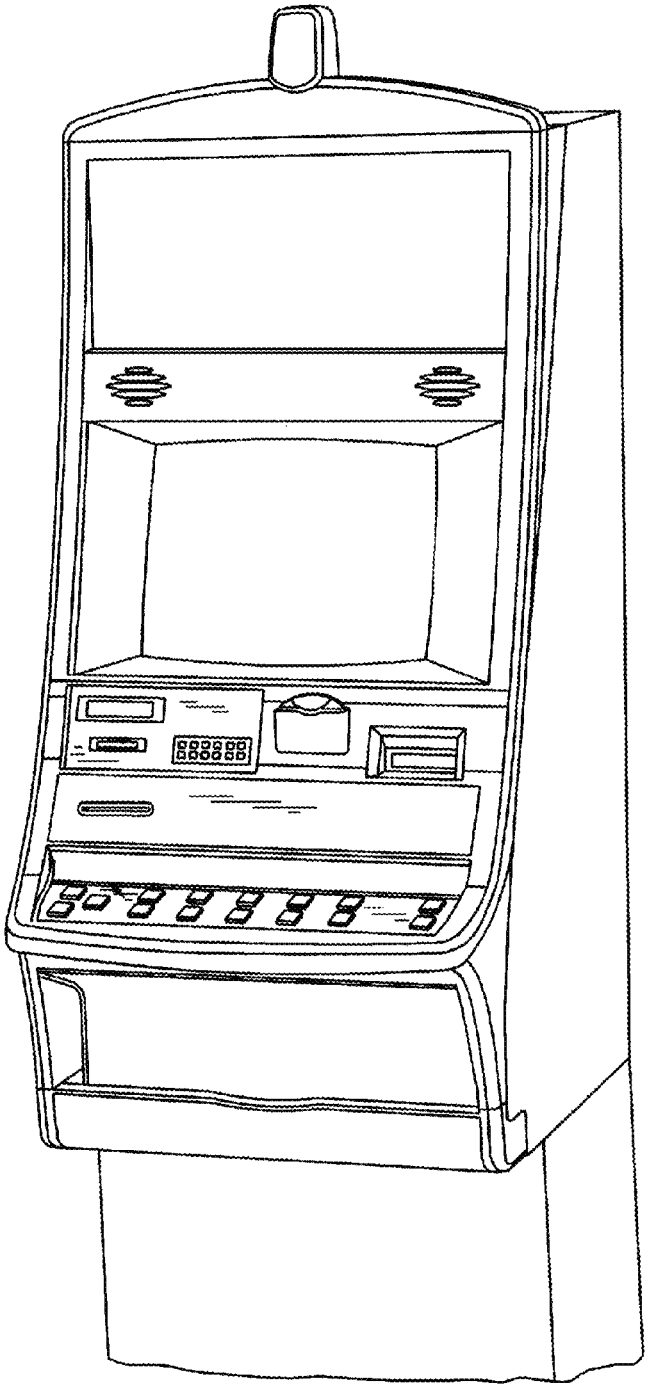

FIG. 19 is a block diagram illustrating hardware that can be used to implement the methods described herein.

A processing unit 1900 (such as a microprocessor and associated structure such as cache, bus, etc.) is connected to an input unit 1901 (such as touch-screen, keyboard, buttons, etc.) an output unit 1902 (such as a touch-screen, speakers, LCD, etc.). The processing unit 1900 is also connected to a ROM 1907 a RAM 1908 and a network connection 1906 (which can be used to connect to a computer communications network such as the Internet, WAN, LAN, etc.) The processing unit is also connected to a storage device 1905 such as a CD-ROM drive, DVD, BLU-ray drive, etc. A computer readable storage medium 1908 can be read by the storage device 1905 and can store a program to control a computer to perform any of the methods described herein. The processing unit 1900 can also be connected to a bill acceptor 1904 which can accept payment (cash, cashless vouchers, e-payment, etc.) and a payment unit 1903 (coin dispenser, cashless ticket dispenser, etc.)

Any description of a component or embodiment herein also includes hardware, software, and configurations which already exist in the prior art and may be necessary to the operation of such component(s) or embodiment(s).

Further, the operations described herein can be performed in any sensible order. Any operations not required for proper operation can be optional. Further, all methods described herein can also be stored on a computer readable storage to control a computer.

The many features and advantages of the invention are apparent from the detailed specification and, thus, it is intended by the appended claims to cover all such features and advantages of the invention that fall within the true spirit and scope of the invention. Further, since numerous modifications and changes will readily occur to those skilled in the art, it is not desired to limit the invention to the exact construction and operation illustrated and described, and accordingly all suitable modifications and equivalents may be resorted to, falling within the scope of the invention.

What is claimed is:

1. A method for playing a slot machine game, the method comprising:

executing instructions on an electronic processing unit which perform:

receiving a wager from a player;

displaying a first wheel comprising a first set of symbols and a second wheel comprising a second set of symbols, wherein the first wheel and the second wheel share at least one fixed intersecting position with only one intersecting symbol located at the intersecting position, wherein the first set of symbols on the first wheel and the second set of symbols on the second wheel both comprise the intersecting symbol located at the intersecting position, wherein all of the first set of symbols are visible and all of the second set of symbols are visible;

spinning the first wheel which rotates the first set of symbols which includes the intersecting symbol located at the intersecting position;

spinning the second wheel which rotates the second set of symbols which includes a current intersecting symbol located at the intersecting position; and evaluating symbols on a payline to determine whether the symbols on the payline form a winning combination, and if so, paying the player an award associated with the winning combination.

2. The method as recited in claim 1, wherein the slot machine game further comprises a third wheel comprising symbols, wherein the third wheel and the second wheel share at least one common reel stop therebetween.

3. The method as recited in claim 2, wherein the third wheel and the first wheel share at least one common reel stop therebetween.

4. The method as recited in claim 1, further comprising, allowing the player to select a selected wheel out of the first wheel and the second wheel and spinning the selected wheel.

5. The method as recited in claim 1, further comprising allowing the player to select a sequence in which to spin the first wheel and the second wheel and spinning the first wheel and the second wheel in the sequence.

6. The method as recited in claim 2, further comprising allowing the player to select a selected wheel out of the first wheel and the second wheel and the third wheel and spinning the selected wheel.

7. The method as recited in claim 2, further comprising allowing the player to select two selected wheels out of the first wheel and the second wheel and the third wheel and spinning the two selected wheels.

8. The method as recited in claim 2, further comprising allowing the player to select a sequence in which to spin the first wheel and the second wheel and the third wheel and spinning the first wheel and the second wheel and the third wheel in the sequence.

9. An electronic gaming device, comprising:

an input device;

an output device;

a processing unit connected to the input device and the output device and executing instructions to control a computer to perform:

receive a wager from a player;

display a first wheel comprising a first set of symbols and a second wheel comprising a second set of symbols, wherein the first wheel and the second wheel share at least one fixed intersecting position with only one intersecting symbol located at the intersecting position, wherein the first set of symbols on the first wheel and the second set of symbols on the second wheel both comprise the intersecting symbol located at the intersecting position, wherein all of the first set of symbols on the first wheel are visible and all of the second set of symbols on the second wheel are visible;

spin the first wheel which rotates the first set of symbols which includes the intersecting symbol located at the intersecting position;

spin the second wheel which rotates the second set of symbols which includes a current intersecting symbol located at the intersecting position; and evaluate symbols on a payline to determine whether the symbols on the payline form a winning combination, and if so, paying the player an award associated with the winning combination.

10. The device as recited in claim 9, wherein the instructions are further configured to display a third wheel comprising symbols, wherein the third wheel and the second wheel share at least one common reel stop therebetween.

11. The device as recited in claim 10, wherein the instructions are further configured such that the third wheel and the first wheel share at least one common reel stop therebetween.

12. The device as recited in claim 9, wherein the instructions are further configured to allow the player to select a selected wheel out of the first wheel and the second wheel, and spinning the selected wheel.

13. The device as recited in claim 9, wherein the instructions are further configured to allow the player to select a sequence in which to spin the first wheel and the second wheel, and spinning the first wheel and the second wheel in the sequence.

14. The device as recited in claim 10, wherein the instructions are further configured to allow the player to select a selected wheel out of the first wheel and the second wheel and the third wheel, and spinning the selected wheel.

15. The device as recited in claim 10, wherein the instructions are further configured to allow the player to select two selected wheels out of the first wheel and the second wheel and the third wheel, and spinning the two selected wheels.

16. The device as recited in claim 10, wherein the instructions are further configured to allow the player to select a sequence in which to spin the first wheel and the second wheel and the third wheel, and spinning the first wheel and the second wheel and the third wheel in the sequence.

17. The device as recited in claim 10, wherein the third wheel and the first wheel do not share a common symbol therebetween, and the first wheel and the third wheel spin simultaneously and the first wheel and the second wheel do not spin simultaneously.

18. The method as recited in claim 1, wherein before the spinning the first wheel, a particular symbol is located on the first wheel, and after the spinning the second wheel is completed, the particular symbol has relocated from being on the first wheel to being on the second wheel.

19. The apparatus as recited in claim 9, wherein the instructions are further configured such that, a first symbol on the first wheel before the spinning the first wheel is, after the spinning the second wheel is completed, relocated to being on the second wheel.

20. The method as recited in claim 2, wherein the third wheel and the first wheel do not share a symbol therebetween, and the first wheel and the third wheel spin simultaneously and the first wheel and the second wheel do not spin simultaneously, the three wheels arranged horizontally.

* * * * *